US008438945B2

(12) United States Patent
Kim et al.

(10) Patent No.: US 8,438,945 B2
(45) Date of Patent: May 14, 2013

(54) ELECTRONIC ORGAN TYPE ACCELERATOR PEDAL

(75) Inventors: Eunsik Kim, Daegu (KR); Yangrae Cho, Hwaseong-si (KR); Byungju Kim, Daegu (KR); Donghwan Kim, Ulsan (KR)

(73) Assignees: Kia Motors Corporation, Seoul (KR); Hyundai Motor Company, Seoul (KR); Donghee Industrial Co., Ltd., Ulsan (KR)

( * ) Notice: Subject to any disclaimer, the term of this patent is extended or adjusted under 35 U.S.C. 154(b) by 109 days.

(21) Appl. No.: 12/621,358

(22) Filed: Nov. 18, 2009

(65) Prior Publication Data

US 2010/0139445 A1 Jun. 10, 2010

(30) Foreign Application Priority Data

Dec. 4, 2008 (KR) ..... 10-2008-0122506

(51) Int. Cl.
*G05G 1/38* (2008.04)

(52) U.S. Cl.
USPC ..... 74/513; 74/514; 74/560

(58) Field of Classification Search ..... 74/512–514, 74/560; *B60K 26/02*
See application file for complete search history.

(56) References Cited

U.S. PATENT DOCUMENTS 3,554,096 A * 1/1971 DeJager ..... 92/125
5,868,039 A 2/1999 Baumann
6,155,133 A * 12/2000 Swansegar et al. ..... 74/513
6,209,418 B1 4/2001 Kalsi et al.
6,412,364 B1 * 7/2002 Berglar ..... 74/514
6,474,191 B1 11/2002 Campbell
6,666,106 B1 * 12/2003 Hueges et al. ..... 74/514
7,387,047 B2 * 6/2008 Kim ..... 74/512
7,823,481 B2 * 11/2010 Makino et al. ..... 74/512
7,984,664 B2 * 7/2011 Kim et al. ..... 74/513
2007/0157755 A1 * 7/2007 Kim et al. ..... 74/513
2007/0193401 A1 8/2007 Campbell
2008/0083295 A1 * 4/2008 Kim et al. ..... 74/513

FOREIGN PATENT DOCUMENTS

JP 2005-173274 A 6/2005
JP 2006-335352 A 12/2006
KR 2002-0008236 A 1/2002
KR 10-0644796 B1 11/2006
KR 10-0718541 B1 5/2007
KR 10-0841924 B1 6/2008

* cited by examiner

*Primary Examiner* — Marcus Charles
*Assistant Examiner* — Thomas Diaz
(74) *Attorney, Agent, or Firm* — Morgan, Lewis & Bockius LLP

(57) ABSTRACT

An electronic organ type accelerator pedal apparatus, may include a pedal housing having a pedal arm receiving space therein and a carrier fitting hole, a pedal pivotally hinged to a hinged portion of the pedal housing, a pedal arm pivotally mounted to an inner surface of the pedal housing, wherein one end portion of the pedal arm is elastically biased by an elastic member and the other end portion of which is pivotally coupled to the pedal through the carrier fitting hole to transfer an activating force of the pedal to the other end portion of the pedal arm, and a damping stopper fixed to the inner surface of the pedal housing in the pedal arm receiving space and selectively engaged with the other end portion of the pedal arm to limit a rotation of the pedal arm when the pedal arm is rotated by the elastic member.

8 Claims, 10 Drawing Sheets

ELECTRONIC ORGAN TYPE ACCELERATOR PEDAL

CROSS-REFERENCE TO RELATED APPLICATIONS

The present application claims priority to Korean Patent Application Number 10-2008-0122506 filed Dec. 4, 2008, the entire contents of which application is incorporated herein for all purposes by this reference.

BACKGROUND OF THE INVENTION

1. Field of the Invention

The present invention relates to an electronic organ type accelerator pedal.

2. Description of Related Art

In general, accelerator pedals of vehicles are devices for adjusting the number of revolution of an engine by adjusting the intake amount of gas mixture in a gasoline engine and adjusting the injection amount of fuel in a diesel engine, and divided into a pendant type accelerator pedals that is held on the dash panel and an organ type accelerator pedal that is mounted on the floor panel in accordance with the mounting structure, and a mechanical type and an electronic type accelerator pedals in accordance with the operation method.

The pendent type accelerator pedal is recently widely used and gives bad operational feeling due to insensitiveness to a driver and fatigue correspondingly increases. Further, it is difficult to precisely open/close a throttle valve, such that fuel is wasted and fuel efficiency is deteriorated while the safety is low. Accordingly, an organ type accelerator pedal has been increasingly provided in deluxe vehicles in recent years.

On the other hand, a mechanical accelerator pedal adjusts the amount of combustion by opening/closing the throttle valve in a carburetor using an accelerator cable. The mechanical accelerator pedal generates errors of the operational range of the throttle valve and an injection pump when the tensile force of the accelerator cable is changed by changes of the environment or decrepitude.

Accordingly, an electronic accelerator pedal that electronically controls the engine and the other peripheral parts has been developed in recent years to prevent the problem.

The electronic accelerator pedal is not provided with an accelerator pedal cable, such that it is possible to ensure sufficient space, and improve operational feeling and reduce fatigue of a driver because it is not influenced by changes in tensile force of a cable. Further, it is possible to reduce fuel consumption by improving fuel efficiency.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an electronic organ type accelerator pedal that makes it possible to reduce the cost and noise and improve durability, change the position of a pedal sensor to correct an output error of the pedal sensor when the output error is generated by misassembling, and can be used regardless of the types of pedal sensors by selectively mounting an inexpensive contact type pedal sensor and an expensive non-contact type pedal sensor, if needed.

In an aspect of the present invention, the electronic organ type accelerator pedal apparatus, may include a pedal housing having a pedal arm receiving space therein and a carrier fitting hole, a pedal pivotally hinged to a hinged portion of the pedal housing, a pedal arm pivotally mounted to an inner surface of the pedal housing in the pedal arm receiving space, wherein one end portion of the pedal arm is elastically biased by an elastic member disposed in the pedal housing and the other end portion of which is pivotally coupled to a portion of the pedal through the carrier fitting hole to transfer an activating force of the pedal to the other end portion of the pedal arm, and a damping stopper fixed to the inner surface of the pedal housing in the pedal arm receiving space and selectively engaged with the other end portion of the pedal arm to limit a rotation of the pedal arm when the pedal arm is rotated by the elastic member.

The electronic organ type accelerator pedal apparatus may further include a pedal sensor which is fixed to the pedal housing and engaged with the one end portion of the pedal arm through a protrusion hole formed on the pedal housing to measure an angular displacement of the pedal arm, wherein bolts holes are formed through the pedal sensor, for combination with the pedal housing, and the bolt holes are formed in elliptical shapes.

The damping stopper may be an elastic member.

The hinged portion of the pedal housing may be fixed to a floor panel under a driver's seat, wherein a hinge fitting groove that is open upward and to a lateral side is formed to the hinged portion, and wherein the pedal includes a hinge portion to be hingedly fitted into the hinge fitting groove of the pedal housing, and wherein a hinge protrusion is formed to the hinge portion of the pedal in a triangular cross section having a declined surface that gradually protrudes downwards from a bottom surface of the hinge portion.

A kick down switch may be connected to the other end portion of the pedal arm and selectively contacts with a bottom surface of the pedal housing, when the pedal arm rotates toward the bottom surface of the pedal housing.

Teflon coating may be applied to a coupling portion between the pedal housing and the pedal arm to prevent friction.

The elastic member may include a first elastic member and a second elastic member enclosing the first elastic member, an elastic pad portion being disposed therebetween.

According to various aspects of the present invention, a hinge portion and a pad portion of a pedal is integrally formed, such that it is possible to reduce the manufacturing process and the cost. It is possible to reduce the cost and weight by applying Teflon coating to a plurality of portions corresponding friction portions. Since it is possible to change the position of a pedal sensor while rotating it little by little using elliptical bolt holes until the output voltage of the pedal sensor fastened to a housing cover becomes normal, it is possible to prevent the pedal sensor from being unnecessarily removed and considerably reduce the cost. Further, since it is possible to selectively mount an inexpensive contact type pedal sensor and an expensive non-contact type pedal sensor to an accelerator pedal implementing one mechanism, if needed, the accelerator pedal can be used regardless of the types of the pedal sensor.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
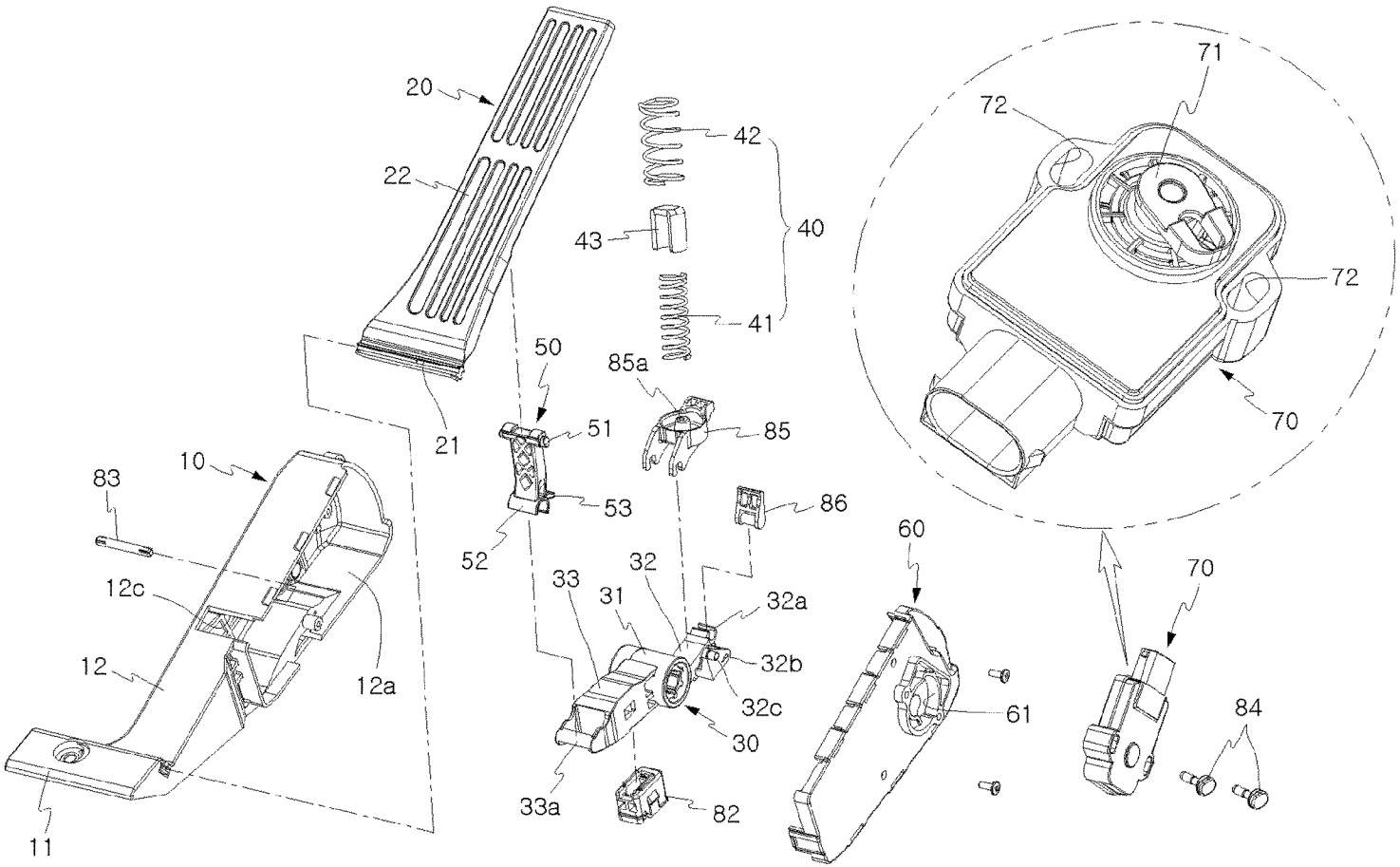
FIG. 1 is an exploded perspective view of an electronic organ type accelerator pedal according to an exemplary embodiment of the present invention.
Figure 2:
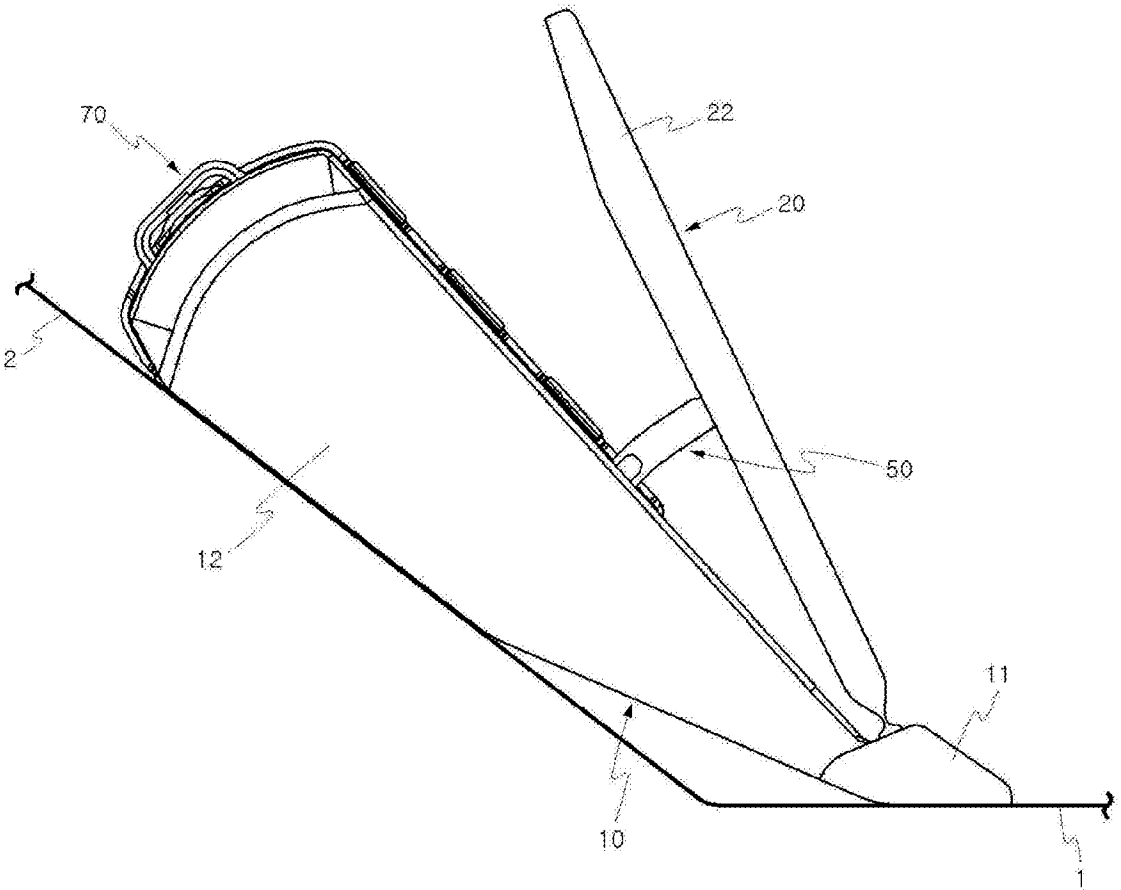
FIGS. 2 and 3 are a left side view and a right side view of the electronic organ type accelerator pedal of FIG. 1 which is assembled.
Figure 3:
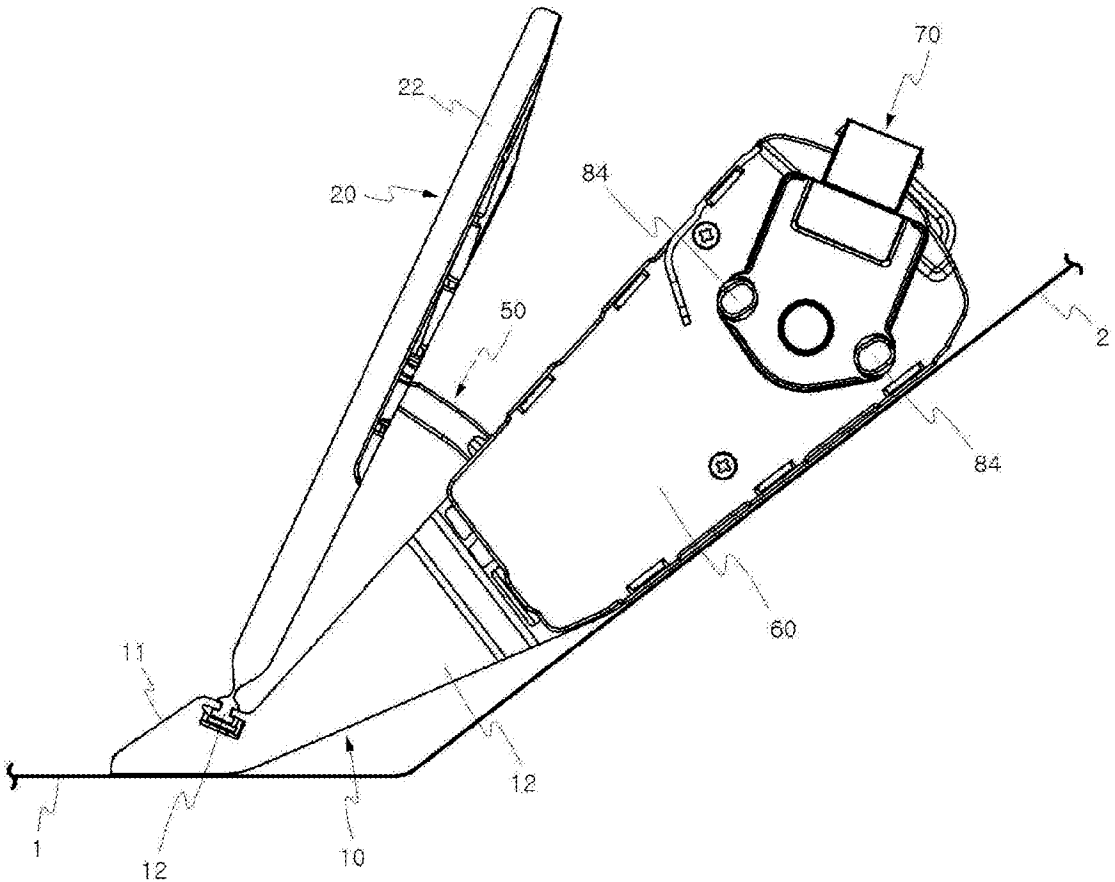
Figure 4:
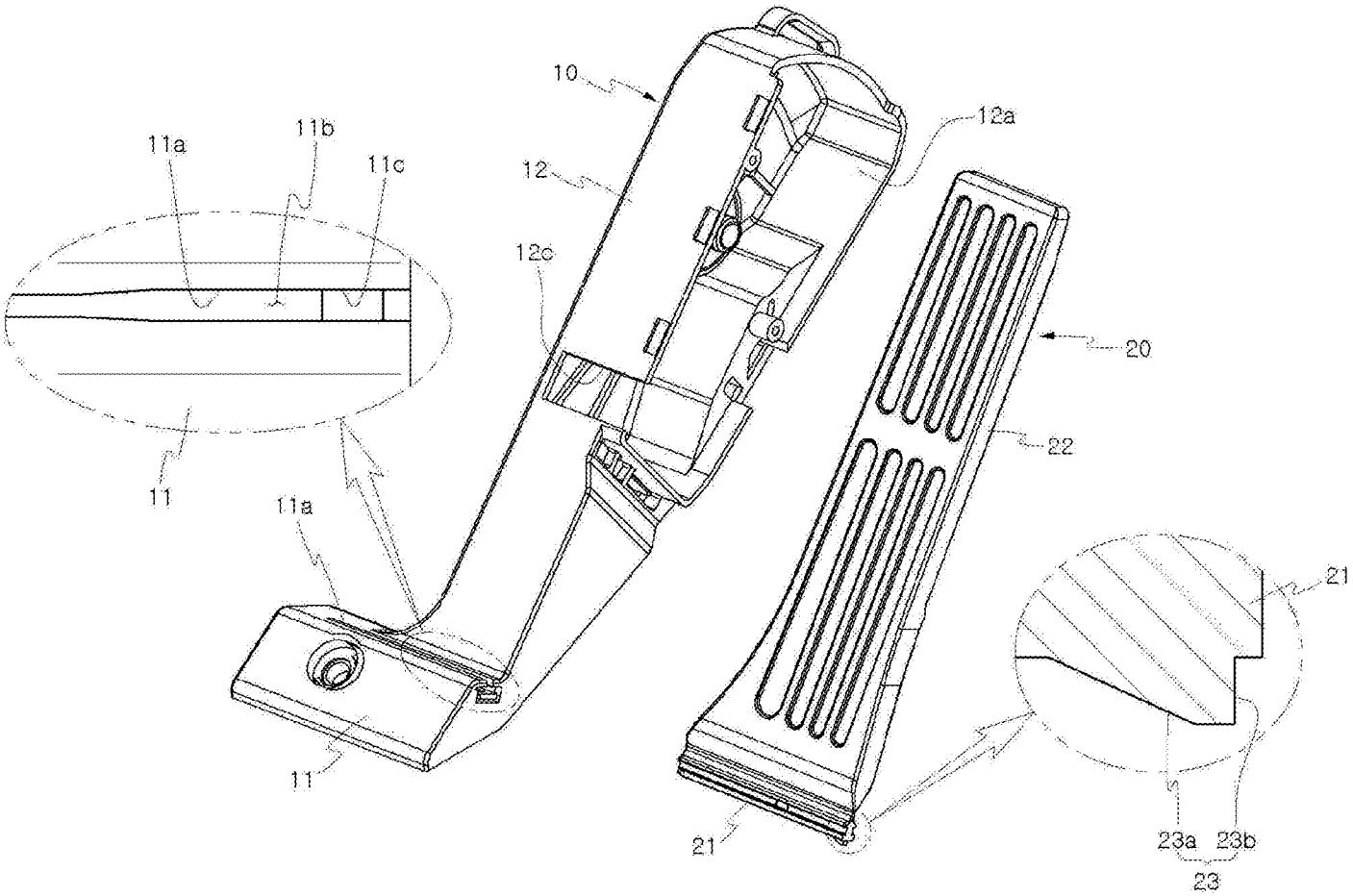
FIGS. 4 to 10 are views illustrating the parts of the electronic organ type accelerator pedal according an exemplary embodiment of to the present invention.
Figure 5:
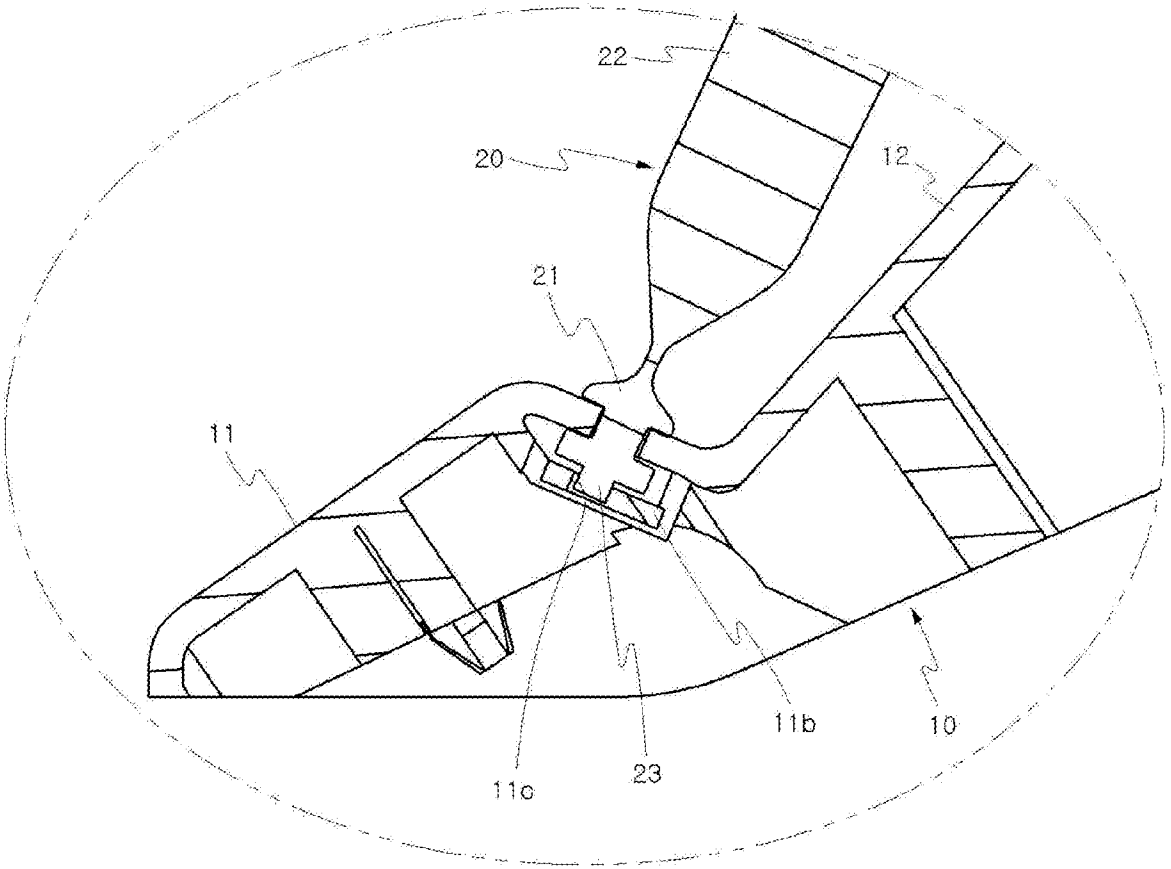
Figure 6:
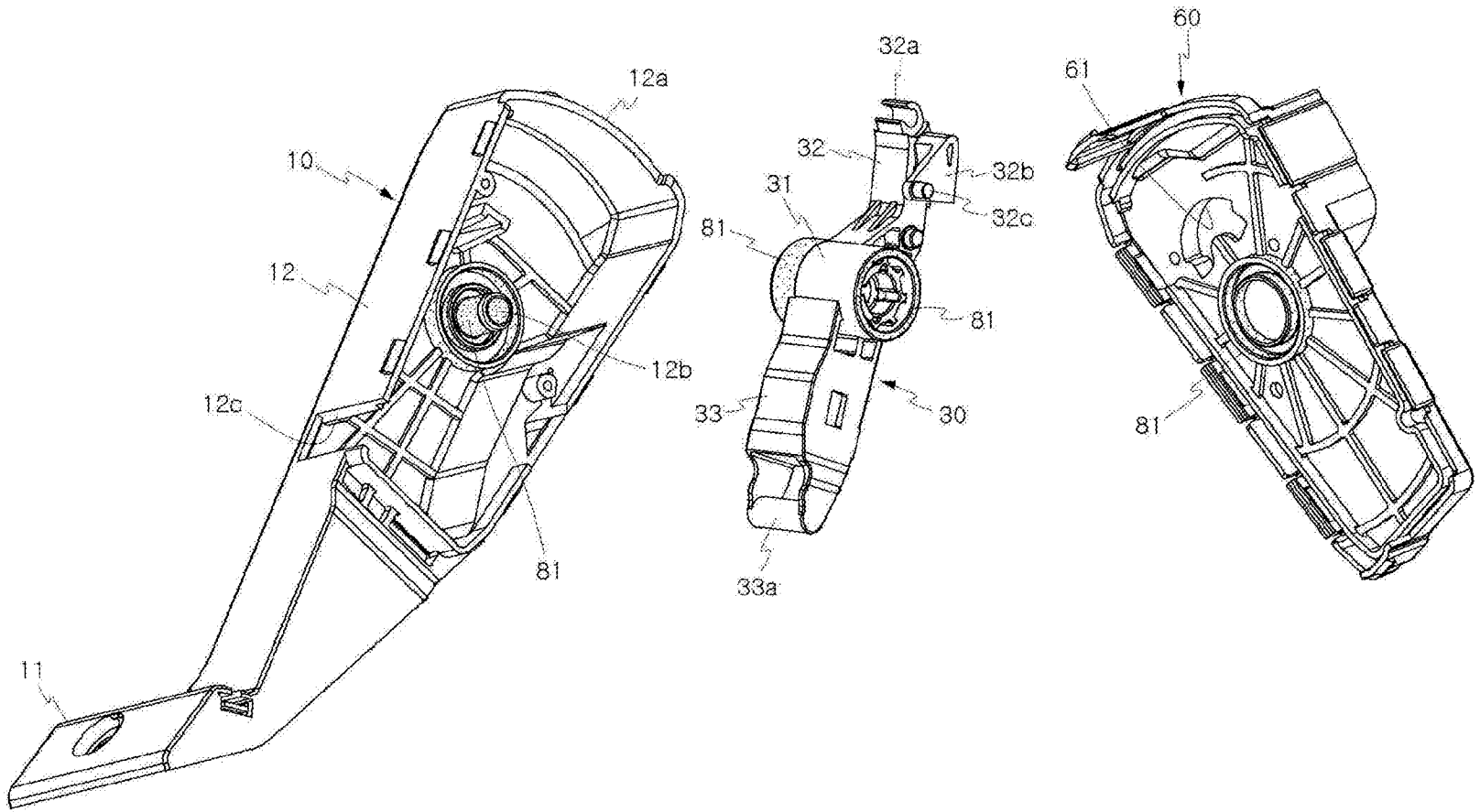
Figure 7:
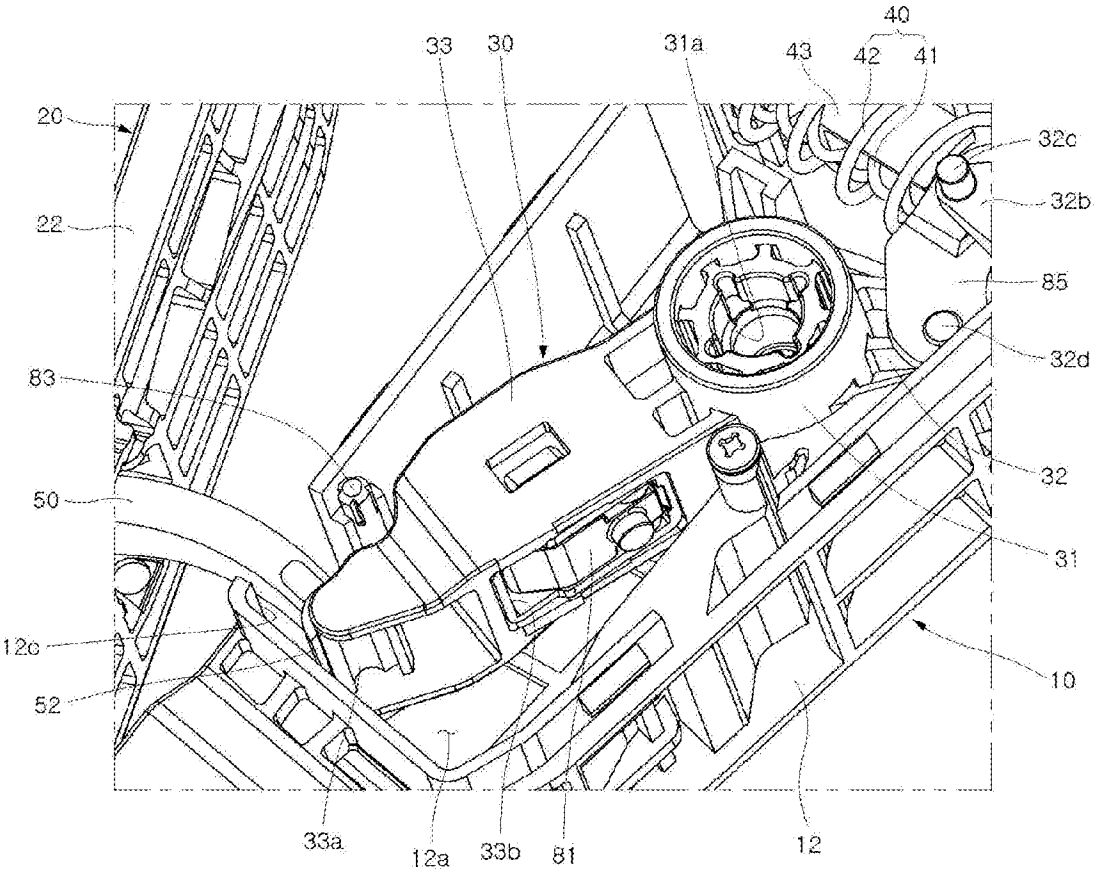
Figure 8:
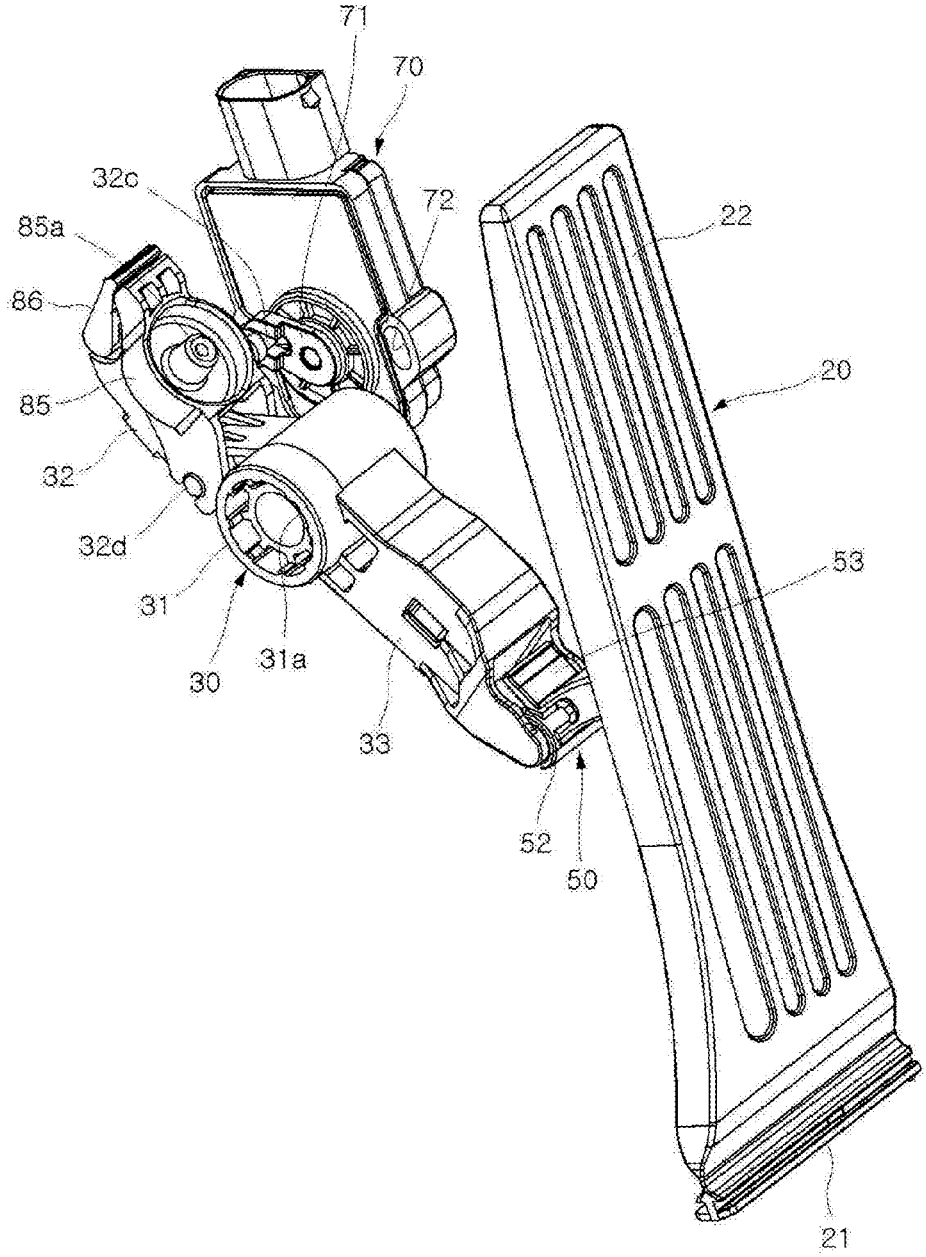
Figure 9:
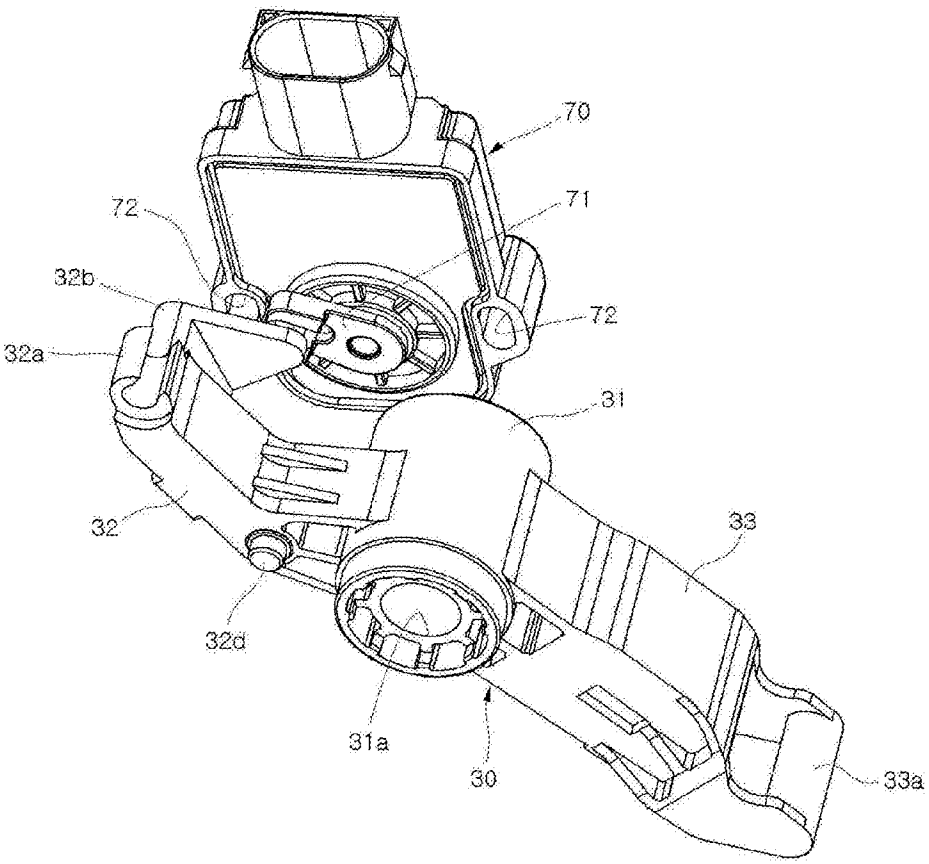

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An electronic organ type accelerator pedal according to an exemplary embodiment of the present invention, as shown in FIGS. 1 to 10, is disposed by fixing a pedal housing 10 to a floor panel 1 and a dash panel 2 extending from floor panel 1 under the driver's seat.

That is, pedal housing 10 is fixed to floor panel 1 under the driver's seat and composed of a hinged portion 11 having a hinge fitting groove 11*a* that is open upward and to one side and a body 12 that is integrally formed with hinged portion 11 and fixed to dash panel 2 under the driver's seat.

A protrusion fitting hole 11*c* is formed through the bottom 11*b* of hinge fitting groove 11*a*.

Body 12 has a pedal arm receiving space 12*a* that is open to one side and formed therein, a rotational shaft protrusion 12*b* that protrudes from the inside wall of pedal arm receiving space 12*a*, and a carrier fitting hole 12*c* that is open upward from pedal arm receiving space 12*a*.

A pedal 20 that is operated by the driver's foot is combined with pedal housing 10. Pedal 20 includes a hinge portion 21 that is fitted in hinge fitting groove 11*a* and a pad portion 22 that is integrally formed with hinge portion 21 to be pressed down by the driver's foot, and it operates rotatably up/down with respect to pedal housing 10.

The integral structure of hinge portion 21 and pad portion 22 makes it possible to reduce the manufacturing process and the cost.

A hinge protrusion 23 that is fitted into protrusion fitting hole 11*c* when hinge portion 21 is fitted into hinge fitting groove 11*a* integrally protrudes down from the bottom of hinge portion 21.

Hinge protrusion 23 is formed in a triangular cross section having a declined surface 23*a* that gradually protrudes down from the bottom of hinge portion 21 and a vertical surface 23*b* that connects the end of declined surface 23*a* with the bottom of hinge portion 21.

By fitting hinge protrusion 23 in hinge fitting groove 11*a*, the connecting force between hinge portion 21 of pedal 20 and hinge fitting groove 11*a* of pedal housing 10 is increased, and accordingly, pedal 20 is not separated from pedal housing 10 even though pedal 20 is repeatedly operated.

A pedal arm 30 is rotatably disposed in pedal arm receiving space 12*a* of body 12 of pedal housing 10.

That is, pedal arm 30 is fitted on rotational shaft protrusion 12*b* to be rotatable in pedal arm receiving space 12*a*, in which one end receives elastic force of a spring member 40 supported by body 12 of pedal housing 10, a sensor fitting protrusion 32*c* integrally protrusion from one side of the end receiving the elastic force of spring member 40, and the other end faces carrier fitting hole 12*c*.

Further, an embodiment of the present invention includes a carrier 50 of which one end is connected with pad portion 22 of pedal 20 and the other end is connected with pedal arm 30 through carrier fitting hole 12*c*, a housing cover 60 that is combined with body 12 to close the open side of body 12 of pedal housing 10, and a pedal sensor 70 that is fixed to a side of housing cover 60 and connected with pedal arm 30.

Pedal arm 30 has a cylindrical portion 31 that has a rotational center hole 31*a* where rotational shaft protrusion 12*b* in pedal housing 10 is inserted and of which both sides are in rotatably contact with body 12 of pedal housing 10 having rotational shaft protrusion 12*b* and the inner side of housing cover 60, a front arm 32 that integrally protrudes in one direction from cylindrical portion 31 and receives the elastic force of spring member 40 at the end where a fork 32*a* in which an arm bracket 32*b* is formed on one side of fork 32*a* and sensor fitting protrusion 32*c* integrally protrudes from arm bracket 32*b*, and a rear arm 33 that integrally protrudes in one direction from cylindrical portion 31 and has a rod 33*a* at the end connected with carrier 50.

In this configuration, Teflon coating 81 is applied to rotational shaft protrusion 12*b* of pedal housing 10, both sides of cylindrical portion 31 of pedal arm 30, body 12 of pedal housing 10 that contacts with both sides of cylindrical portion 31, and the inner side of housing cover 60, to prevent friction.

Teflon coating 81 is a fluorine resin coating having inherent characteristics of Teflon, such as non-adhererance (separation), heat resistance, chemical resistance, abrasion resistance, and electric conductivity, by applying Teflon coating (fluorine resin) to a material, such as iron, stainless steel, aluminium, copper, glass, rubber, ceramic, and plastic, by process of spraying or powder electrostatic coating, drying, heating, sintering. The inherent separation, the Teflon coating has chemical resistance, heat resistance, insulation safety, and low frictional coefficient, such that it is a technology having various functions, easily overcoming a problem of surface process that is difficult to be solved by other products.

It is possible to remove a hinge bush, which is generally used, by applying Teflon coating 81, and accordingly, the cost and weight are reduced.

A switch groove 33*b* that is open downward is formed in rear arm 33 of pedal arm 30 and a kick down switch 82 that gives kick down feeling to a driver is inserted in switch groove 33*b*.

Kick down switch 82 is disposed to operate in contact with the bottom of body 12 of pedal housing 10, when rear arm 33 rotates to the bottom of body 12 of pedal housing 10.

Carrier 50 is provided to transmit rotational force, which is generated when the driver presses down pad portion 22 of pedal 20 and pad portion 22 is correspondingly rotates to body 12 of pedal housing 10, to pedal arm 30. A fitting protrusion 51 that is rotatably fitted in a fitting hole (not shown) of pad portion 22 is formed at both sides of the upper end, a fork 52 that is fitted around rod 33*a* formed at rear arm 33 of pedal arm 30 is formed at the lower end, and a carrier protrusion 53 integrally protruding at the above fork 52 is formed in the longitudinal direction of body 12 and positioned in pedal arm receiving space 12*a*.

Carrier 50 prevents pedal 20 from rotating to body 12 of pedal housing 10 by own weight.

A damping stopper 83 that contacts with carrier protrusion 53 when pedal arm 30 is rotated by the elastic return force of spring member 40 is disposed in pedal arm receiving space 12*a* of body 12 of pedal housing 10.

Damping stopper 83 is provided to determine the initial position of pad portion 22 of pedal 20 by contacting with carrier protrusion 53, when pad portion 22 is rotated upward from body 12 by the elastic return force of spring member 40 after being pressed down to body 12 of pedal housing 10 by the driver, and preferable made of rubber to prevent a noise when contacting with carrier protrusion 53.

Sensor fitting protrusion 32*c* of pedal arm 30 is combined with a sensor lever 71 of pedal sensor 70 through housing cover 60.

For this configuration, a protrusion hole 61 is formed through housing cover 60 such that sensor fitting protrusion 32*c* can smoothly rotate about the center of rotational shaft protrusion 12*b*.

As pedal arm 30 rotates, sensor fitting protrusion 32*c* rotates, and as sensor fitting protrusion 32*c* rotate, sensor lever 71 rotates correspondingly.

Pedal sensor 70 detects changes in output by rotation of sensor lever 71, when sensor lever 71 rotates, and transmits the detected signal to a throttle control unit.

The throttle control unit receiving the electric signal from pedal sensor 70 activates an actuator by sending a control signal, and the amount of combustion is adjusted while a throttle valve is opened/closed by operation of the actuator.

Pedal sensor 70 is fastened to a side of housing cover 60 by a plurality of bolts 84.

For this configuration, bolt holes 72 through which bolts 84 are inserted are formed through pedal sensor 70, in which bolt holes 72 are formed elliptical shapes.

The reason that bolt holes 72 are formed in elliptical shapes is for changing the position of pedal sensor 70 while rotating it little by little when output voltage of pedal sensor 70 is abnormal, after pedal sensor 70 is fastened to housing cover 60.

That is, although the pedal sensor was removed when the output voltage was abnormal because it was impossible to change the position of the pedal sensor once it was mounted in the related art, in an embodiment of the present invention, it is possible to change the position of pedal sensor 70 while rotating it little by little until the output voltage of pedal sensor 70 becomes normal, using elliptical bolt holes 72.

Therefore, an embodiment of the present invention largely helps reduce the cost.

Further, according to an embodiment of the present invention, it is possible to selectively mount an inexpensive contact type pedal sensor and an expensive non-contact type pedal sensor to the accelerator pedal forming one mechanism, if needed.

That is, it is possible to selectively fit any one of an inexpensive contact type pedal sensor and an expensive non-contact type pedal sensor on sensor fitting protrusion 32*c* of pedal arm 30.

As described above, according to an embodiment of the present invention, since it is possible to selectively mount an inexpensive contact type pedal sensor and an expensive non-contact type pedal sensor to the accelerator pedal forming one mechanism, if needed, it can be used regardless of the types of pedal sensor 70.

Advantage of the present invention described above can considerably reduce the cost, as compared with the related art, which required to develop an accelerator pedal having different configurations in accordance with the types of pedal sensors.

On the other hand, plate protrusions 32*d* protrude from both sides of front arm 32 of pedal arm 30 and a spring plate 85 is fitted around plate protrusions 32*d*.

A spring protrusion 85*a* where the lower end of spring member 40 is fitted protrudes upward from the upper surface of spring plate 85.

The present invention further includes a friction shoe 86 that is fitted in fork 32*a* of front arm 32 of pedal arm 30.

The front end of friction shoe 86 contacts with spring plate 85.

Friction shoe 86 causes friction by selectively contacting with the inner side of body 12 of pedal housing 10 when pedal arm 30 is operated, and achieves hysteresis by reducing vibration and noise created in increasing output of the engine.

Spring member 40 is a compression spring and the lower end of spring member 40 is fitted on spring protrusion 85*a* of spring plate 85 and the upper end extending vertically upward is inserted in a spring groove (not shown) formed on the inner upper surface of body 12.

Spring member 40 has a double structure of an inner spring 41 and an outer spring 42 according to an exemplary embodiment of the present invention.

Outer spring 42 is formed to have a larger diameter than inner spring 41 and fitted around inner spring 41.

A pad member 43 is inserted between inner spring 41 and outer spring 42 to prevent interference and a sponge is used as pad member 43.

The operation and effect of an embodiment of the present invention is described hereafter.

As a driver presses down pad portion 22 of pedal 20, pad portion 22 is rotated to body 12 of pedal housing 10 by hinge portion 21 and carrier 50 moves down.

Figure 10:
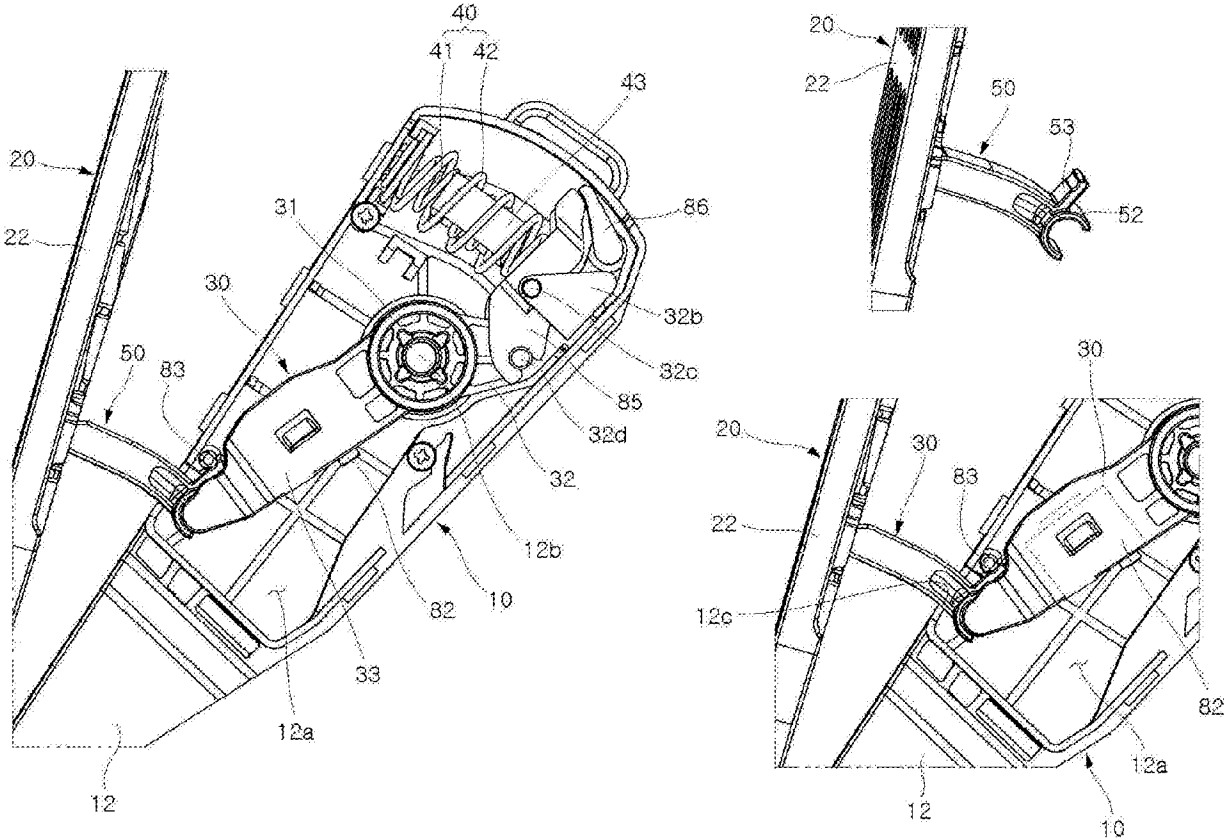

As carrier 50 moves, pedal arm 30 rotates counterclockwise about rotational shaft protrusion 12*b* from the position shown in FIG. 10 and spring member 40 is correspondingly deformed such that entire length is reduced.

Meanwhile, sensor fitting protrusion 32*c* rotates with the rotation of pedal arm 30, and as sensor fitting protrusion 32*c* rotates, sensor lever 71 rotates. Pedal sensor 70 detects a change of output value in accordance with operation of sensor lever 71 and sends an electric signal to the throttle control unit, and the throttle control unit adjusts the amount of combustion while opening/closing the throttle valve by sending a control signal to the throttle control unit to activate the actuator.

When the driver releases pad portion 22, pedal arm 30 is rotated clockwise, i.e., in the opposite direction to the above rotational direction by the return force of spring member 40 and carrier 50 moves upward. Further, pad portion 22 rotates away from body 12 of pedal housing 10 and returns to the initial position.

The maximum rotational angle of pad portion 22 rotating upward is restrained by carrier protrusion 53 and damping stopper 83, such that pad portion 22 always returns to the initial position and is ready for the next operation.

Therefore, the electronic organ type accelerator pedal according to an exemplary embodiment of the present invention can maximize the safety using spring member 40 having a double structure of carrier protrusion 53 of carrier 50 and damping stopper 83, which restrain reverse rotation of pad portion 22, while maintaining the advantages of an electronic accelerator pedal that can ensure a sufficient space, improving operational feeling and reducing fatigue of the driver without being influenced by changes of tensile force of a cable, and reducing fuel consumption by improving fuel efficiency.

That is, pad portion 22 that has been pressed down to pedal housing 10 by a driver returns to the initial position while reversing away from pedal housing 10 when being released, in which pad portion 22 may be fully pulled back, when the driver's shoes or cloth is caught on pad 22.

This case frequently occurs when a vehicle travels on a steep upward slope.

However, since carrier protrusion 53 and damping stopper 83 restrain the reverse maximum rotational angle of pad portion 22, pad portion 22 is prevented from fully pulled back from the normal position and the safety of the vehicle is considerably improved.

On the contrary, when a vehicle travels on a steep downward slope, pad portion 22 receives force to rotate it toward pedal housing 10 by the own weight; however, in this condition, carrier 50 receiving the force of spring member 40 through pedal arm 30 restrains rotation of pad portion 22, thereby achieving safety for driver's operation.

Further, even if any one spring of inner spring 41 and outer spring 42 is broken, the other spring can sufficiently performs the function, such that the present invention also largely improves safety.

Further, since hinge portion 21 and pad portion 22 of pedal 20 are integrally formed, the present invention can reduce the manufacturing process and the cost.

Further, since Teflon coating 81 is applied to the friction portion, i.e., rotational shaft protrusion 12*b* of pedal housing 10, both sides of cylindrical portion 31 of pedal arm 30, body 12 of pedal housing 10 which is in contact with both sides of cylindrical portion 31, and the inner side of housing cover 60, the present invention can significantly reduce the cost and weight, without using a hinge bush that is generally used.

Further, since according to an embodiment of the present invention, it is possible to change the position of pedal sensor 70 using elliptical bolt holes 72, until the output voltage of pedal sensor 70 fastened to housing cover 60 becomes normal, it is possible to prevent pedal sensor 70 from being unnecessarily removed and considerably reduce the cost.

Further, according to an embodiment of the present invention, since it is possible to selectively mount an inexpensive contact type pedal sensor and an expensive non-contact type pedal sensor to an accelerator pedal implementing one mechanism, the accelerator pedal can be used regardless of the types of pedal sensor 70 and it is possible to considerably reduce the cost.

For convenience in explanation and accurate definition in the appended claims, the terms "upper" and "lower" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An electronic organ type accelerator pedal apparatus, comprising:

a pedal housing that is fixed to a dash panel under a driver's seat, and has a body provided with a pedal arm receiving space that is open to one side, a rotational shaft protrusion that protrudes from an inner side of the pedal arm receiving space and a carrier fitting hole that is open upward from the pedal arm receiving space;

a pedal arm that is fitted on the rotational shaft protrusion to be rotatable in the pedal arm receiving space, has one end that receives elastic force of a spring member supported by the body, and a sensor fitting protrusion that integrally protrudes from a side of the end that receives the elastic force of the spring member;

a carrier that is combined with the pedal arm through the carrier fitting hole and has a carrier protrusion at a lower portion of the carrier, wherein the carrier protrusion protrudes in a longitudinal direction of the body and is positioned in the pedal arm receiving space;

a housing cover that is combined with the body to cover the open side of the body;

a pedal sensor that has a sensor lever connected with the sensor fitting protrusion and is fastened to a side of the housing cover;

a hinged portion that is integrally formed with the body, fixed to a floor panel under the driver's seat, a hinge fitting groove that is open upward and to a side; and a pad portion that has a hinge portion integrally formed with one end of the pad portion combined with the carrier and fitted in the hinge fitting groove and directly engaged with the hinge fitting groove;

wherein a protrusion fitting hole is formed in the bottom of the hinge fitting groove, wherein a hinge protrusion that is fitted in the protrusion fitting hole but not directly engaged with the hinge fitting groove when the hinge portion is fitted in the hinge fitting groove integrally protrudes down from the bottom of the hinge portion, wherein the hinge protrusion is formed in a substantially triangular cross section along a longitudinal direction of the hinge fitting groove, and wherein the substantially triangular cross section has:

a declined surface that gradually protrudes down from the bottom of the hinge portion along a longitudinal direction of the substantially triangular cross section and is coupled with the hinge fitting groove; and a vertical surface that connects the end of the declined surface with the bottom of the hinge portion and is coupled to the protrusion fitting hole so as to prevent the hinge portion disassembling from the hinge fitting groove by being engaged with the protrusion fitting hole.

2. The electronic organ type accelerator pedal apparatus as defined in claim 1, Wherein the sensor fitting protrusion of the pedal arm is connected with the sensor lever of the pedal sensor through the housing cover.

3. The electronic organ type accelerator pedal apparatus as defined in claim 2, wherein the housing cover has a protrusion hole that allows the sensor fitting protrusion to correspondingly rotate, when the pedal arm rotates.

4. The electronic organ type accelerator pedal apparatus as defined in claim 1, further comprising a damping stopper that is disposed in the pedal arm receiving space of the body of the pedal housing and made of rubber to contact with the carrier protrusion when the pedal arm is rotated by elastic return force of the spring member.

5. The electronic organ type accelerator pedal apparatus as defined in claim 1, wherein the pedal arm has:

a cylindrical portion that has a rotational center hole where the rotational shaft protrusion is inserted and of which both sides are in rotatably contact with the body of the pedal housing having the rotational shaft protrusion and the inner side of the housing cover;

a front arm that integrally protrudes in one direction from the cylindrical portion, receives elastic force of the spring member at the end, and has the sensor fitting protrusion integrally protruding from the side; and a rear arm that integrally protrudes in the other direction from the cylindrical portion and is connected with carrier.

6. The electronic organ type accelerator pedal apparatus as defined in claim 5, wherein a fluorine resin coating is applied to the rotational shaft protrusion, both sides of the cylindrical portion of the pedal arm, the body of the pedal housing that is in contact with both sides of the cylindrical portion, and the inner side of the housing cover, to prevent friction.

7. The electronic organ type accelerator pedal apparatus as defined in claim 5, wherein a kick down switch is connected to the rear arm and disposed to operate in contact with the bottom of the body of the pedal housing, when the rear arm rotates to the bottom of the body of the pedal housing.

8. The electronic organ type accelerator pedal apparatus as defined in claim 1, wherein bolts holes are formed through the pedal sensor, for combination with the housing cover, and the bolt holes are formed in elliptical shapes.

* * * * *